US009494904B2

(12) United States Patent
Watanabe et al.

(10) Patent No.: US 9,494,904 B2
(45) Date of Patent: Nov. 15, 2016

(54) SEPARATION DEVICE, FIXING DEVICE, AND IMAGE FORMING APPARATUS

(71) Applicants: Yohhei Watanabe, Kanagawa (JP); Takashi Sakamaki, Kanagawa (JP); Masateru Ujiie, Kanagawa (JP); Naoto Suzuki, Kanagawa (JP); Fumihiro Hirose, Kanagawa (JP)

(72) Inventors: Yohhei Watanabe, Kanagawa (JP); Takashi Sakamaki, Kanagawa (JP); Masateru Ujiie, Kanagawa (JP); Naoto Suzuki, Kanagawa (JP); Fumihiro Hirose, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 14/885,299

(22) Filed: Oct. 16, 2015

(65) Prior Publication Data

US 2016/0124361 A1 May 5, 2016

(30) Foreign Application Priority Data

Oct. 29, 2014 (JP) ..... 2014-220161
Apr. 17, 2015 (JP) ..... 2015-084887

(51) Int. Cl.
*G03G 15/20* (2006.01)

(52) U.S. Cl.
CPC ..... *G03G 15/2085* (2013.01)

(58) Field of Classification Search
CPC ..... G03G 15/2085
See application file for complete search history.

(56) References Cited

U.S. PATENT DOCUMENTS 4,929,983 A * 5/1990 Barton ..... G03G 15/2028 271/307
2005/0201779 A1* 9/2005 Katayanagi ..... G03G 9/0821 399/223
2009/0003897 A1 1/2009 Yamada
2012/0051805 A1 3/2012 Suzuki et al.
2012/0224893 A1 9/2012 Yamamoto et al.
2013/0330110 A1* 12/2013 Yoshikawa ..... G03G 15/2028 399/323
2014/0212188 A1 7/2014 Watanabe

FOREIGN PATENT DOCUMENTS

| | | |
|---|---|---|
| JP | 2007-047379 | 2/2007 |
| JP | 2008-058371 | 3/2008 |
| JP | 2009-031759 | 2/2009 |
| JP | 2010-217519 | 9/2010 |
| JP | 2011-008103 | 1/2011 |
| JP | 2011-043763 | 3/2011 |
| JP | 2011-180344 | 9/2011 |
| JP | 2011-191509 | 9/2011 |
| JP | 2011-191521 | 9/2011 |

(Continued)

*Primary Examiner* — Sandra Brase
(74) *Attorney, Agent, or Firm* — Oblon, McClelland, Maier & Neustadt, L.L.P.

(57) ABSTRACT

A separation device separates a recording medium ejected from a fixing nip formed between a first rotator and a second rotator from the first rotator. The separation device includes a separator including a front end disposed opposite the fixing nip and the recording medium and a plurality of recesses disposed on the front end of the separator at least in a conveyance span on the separator where the recording medium is conveyed. The plurality of recesses includes a first recess extending in a first extension line that is oblique relative to a recording medium conveyance direction and a second recess adjacent to the first recess and extending in a second extension line that is oblique relative to the recording medium conveyance direction. The second extension line overlaps the first extension line in a direction perpendicular to the recording medium conveyance direction to define an overlap span.

20 Claims, 9 Drawing Sheets

(56) References Cited

FOREIGN PATENT DOCUMENTS

| | | |
|---|---|---|
| JP | 2011-221067 | 11/2011 |
| JP | 2012-042787 | 3/2012 |
| JP | 2012-042853 | 3/2012 |
| JP | 2012-047867 | 3/2012 |
| JP | 2012-048110 | 3/2012 |
| JP | 2012-098604 | 5/2012 |
| JP | 2012-163752 | 8/2012 |
| JP | 2012-180163 | 9/2012 |
| JP | 2012-208170 | 10/2012 |
| JP | 2013-235133 | 11/2013 |
| JP | 2014-021337 | 2/2014 |
| JP | 2014-026118 | 2/2014 |
| JP | 2014-048440 | 3/2014 |
| JP | 2014-059521 | 4/2014 |
| JP | 2014-077901 | 5/2014 |
| JP | 2014-149344 | 8/2014 |
| JP | 2014-153486 | 8/2014 |
| JP | 2014-157215 | 8/2014 |
| JP | 2014-163998 | 9/2014 |
| JP | 2014-174528 | 9/2014 |
| JP | 2014-178532 | 9/2014 |
| JP | 2014-199382 | 10/2014 |
| JP | 2014-235411 | 12/2014 |
| JP | 2015-049288 | 3/2015 |
| JP | 2015-069041 | 4/2015 |

* cited by examiner

SEPARATION DEVICE, FIXING DEVICE, AND IMAGE FORMING APPARATUS

CROSS-REFERENCE TO RELATED APPLICATIONS

This patent application is based on and claims priority pursuant to 35 U.S.C. §119 to Japanese Patent Application Nos. 2014-220161, filed on Oct. 29, 2014, and 2015-084887, filed on Apr. 17, 2015, in the Japanese Patent Office, the entire disclosure of each of which is hereby incorporated by reference herein.

BACKGROUND

Technical Field

Exemplary aspects of the present disclosure relate to a separation device, a fixing device, and an image forming apparatus, and more particularly, to a separation device for separating a recording medium from a rotator, a fixing device incorporating the separation device, and an image forming apparatus incorporating the fixing device.

Description of the Background

Related-art image forming apparatuses, such as copiers, facsimile machines, printers, or multifunction printers having two or more of copying, printing, scanning, facsimile, plotter, and other functions, typically form an image on a recording medium according to image data. Thus, for example, a charger uniformly charges a surface of a photoconductor; an optical writer emits a light beam onto the charged surface of the photoconductor to form an electrostatic latent image on the photoconductor according to the image data; a developing device supplies toner to the electrostatic latent image formed on the photoconductor to render the electrostatic latent image visible as a toner image; the toner image is directly transferred from the photoconductor onto a recording medium or is indirectly transferred from the photoconductor onto a recording medium via an intermediate transfer belt; finally, a fixing device applies heat and pressure to the recording medium bearing the toner image to fix the toner image on the recording medium, thus forming the image on the recording medium. Such fixing device may include a first rotator, such as a fixing roller, a fixing belt and a fixing film, heated by a heater and a second rotator, such as a pressure roller and a pressure belt, pressed against the first rotator to form a fixing nip therebetween through which a recording medium bearing a toner image is conveyed. As the recording medium bearing the toner image is conveyed through the fixing nip, the first rotator and the second rotator apply heat and pressure to the recording medium, melting and fixing the toner image on the recording medium.

SUMMARY

This specification describes below an improved separation device. In one exemplary embodiment, the separation device separates a recording medium ejected from a fixing nip formed between a first rotator and a second rotator from the first rotator. The separation device includes a separator including a front end disposed opposite the fixing nip and the recording medium and a plurality of recesses disposed on the front end of the separator at least in a conveyance span on the separator where the recording medium is conveyed. The plurality of recesses includes a first recess extending in a first extension line that is oblique relative to a recording medium conveyance direction and a second recess adjacent to the first recess and extending in a second extension line that is oblique relative to the recording medium conveyance direction. The second extension line overlaps the first extension line in a direction perpendicular to the recording medium conveyance direction to define an overlap span.

This specification further describes below an improved fixing device. In one exemplary embodiment, the fixing device includes a first rotator, a second rotator pressed against the first rotator to form a fixing nip therebetween, through which a recording medium bearing an unfixed toner image is conveyed, and a separation device disposed downstream from the fixing nip in a recording medium conveyance direction. The separation device separates the recording medium ejected from the fixing nip from the first rotator. The separation device includes a separator including a front end disposed opposite the fixing nip and the recording medium and a plurality of recesses disposed on the front end of the separator at least in a conveyance span on the separator where the recording medium is conveyed. The plurality of recesses includes a first recess extending in a first extension line that is oblique relative to the recording medium conveyance direction and a second recess adjacent to the first recess and extending in a second extension line that is oblique relative to the recording medium conveyance direction. The second extension line overlaps the first extension line in a direction perpendicular to the recording medium conveyance direction to define an overlap span.

This specification further describes an improved image forming apparatus. In one exemplary embodiment, the image forming apparatus includes an image forming device to form a toner image and a fixing device disposed downstream from the image forming device in a recording medium conveyance direction to fix the toner image on a recording medium. The fixing device includes a first rotator, a second rotator pressed against the first rotator to form a fixing nip therebetween, through which the recording medium bearing the toner image is conveyed, and a separation device disposed downstream from the fixing nip in the recording medium conveyance direction. The separation device separates the recording medium ejected from the fixing nip from the first rotator. The separation device includes a separator including a front end disposed opposite the fixing nip and the recording medium and a plurality of recesses disposed on the front end of the separator at least in a conveyance span on the separator where the recording medium is conveyed. The plurality of recesses includes a first recess extending in a first extension line that is oblique relative to the recording medium conveyance direction and a second recess adjacent to the first recess and extending in a second extension line that is oblique relative to the recording medium conveyance direction. The second extension line overlaps the first extension line in a direction perpendicular to the recording medium conveyance direction to define an overlap span.

BRIEF DESCRIPTION OF THE DRAWINGS

A more complete appreciation of the disclosure and the many attendant advantages thereof will be readily obtained as the same becomes better understood by reference to the following detailed description when considered in connection with the accompanying drawings, wherein.

DETAILED DESCRIPTION OF THE DISCLOSURE

Figure 1:
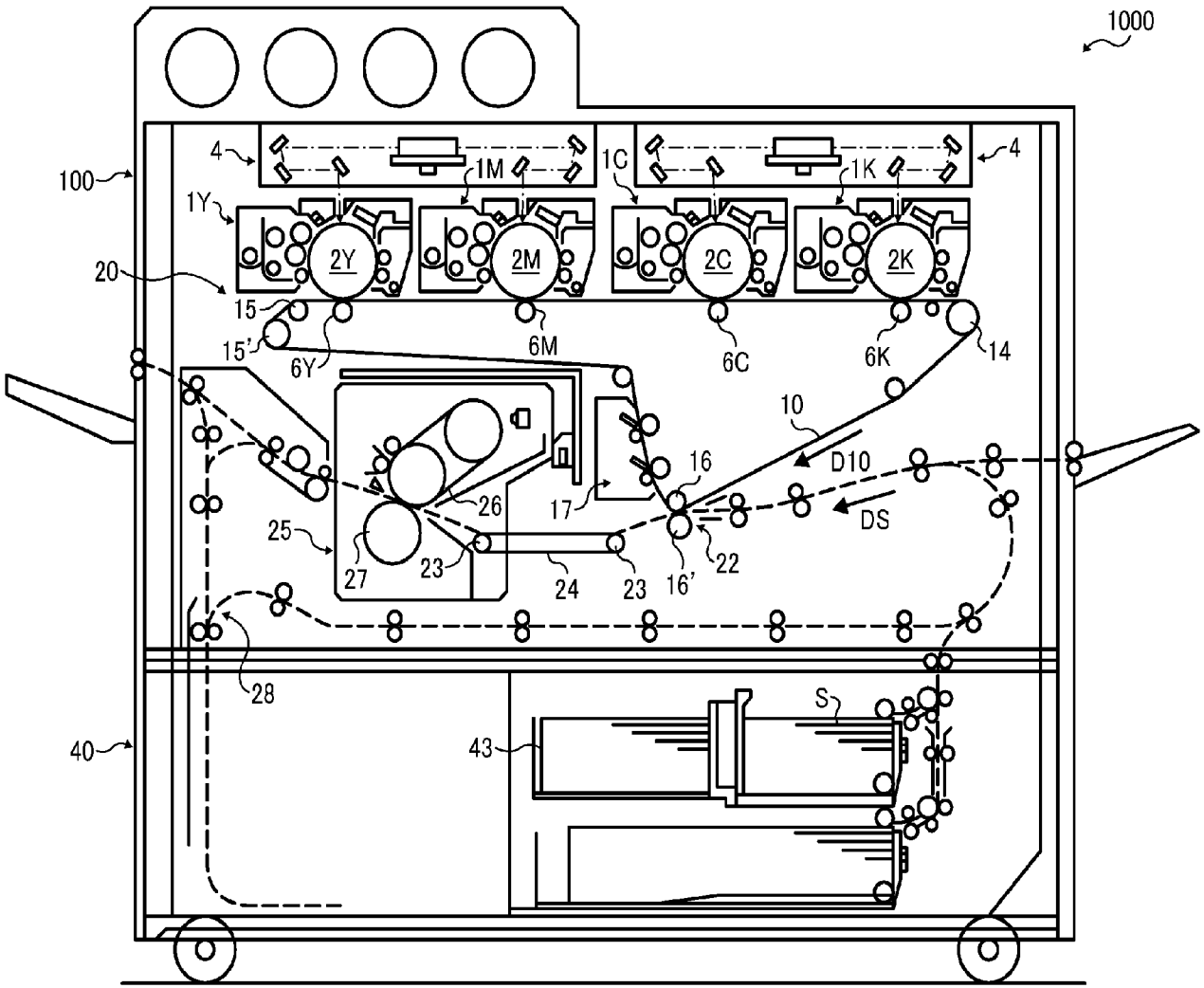
FIG. 1 is a schematic vertical sectional view of an image forming apparatus according to an exemplary embodiment of the present disclosure.

In describing exemplary embodiments illustrated in the drawings, specific terminology is employed for the sake of clarity. However, the disclosure of this specification is not intended to be limited to the specific terminology so selected and it is to be understood that each specific element includes all technical equivalents that operate in a similar manner and achieve a similar result.

Referring now to the drawings, wherein like reference numerals designate identical or corresponding parts throughout the several views, in particular to FIG. 1, an image forming apparatus 1000 according to an exemplary embodiment of the present disclosure is explained.

It is to be noted that, in the drawings for explaining exemplary embodiments of this disclosure, identical reference numerals are assigned, as long as discrimination is possible, to components such as members and component parts having an identical function or shape, thus omitting description thereof once it is provided.

FIG. 1 is a schematic vertical sectional view of the image forming apparatus 1000. The image forming apparatus 1000 may be a copier, a facsimile machine, a printer, a multifunction peripheral or a multifunction printer (MFP) having at least one of copying, printing, scanning, facsimile, and plotter functions, or the like. According to this exemplary embodiment, the image forming apparatus 1000 is a color printer that forms color and monochrome toner images on recording media by electrophotography. Alternatively, the image forming apparatus 1000 may be a monochrome printer that forms a monochrome toner image on a recording medium.

A description is provided of a construction of the image forming apparatus 1000. As shown in FIG. 1, the image forming apparatus 1000 is a printer employing a tandem intermediate transfer method. The image forming apparatus 1000 includes a body 100 and a sheet feeder 40 mounting the body 100. An intermediate transfer belt 10, that is, an endless belt, is situated in a center portion of the body 100. Above the intermediate transfer belt 10 is an image forming device 20. The intermediate transfer belt 10 is looped over a plurality of support rollers 14, 15, 15', and 16 and rotatable clockwise in FIG. 1 in a rotation direction D10. The support roller 14 is a driving roller that drives and rotates the intermediate transfer belt 10. On the left of the support roller 16 is an intermediate transfer belt cleaner 17 that removes residual toner failed to be transferred onto a sheet S serving as a recording medium and therefore remaining on the intermediate transfer belt 10 therefrom. Above the intermediate transfer belt 10 stretched taut across the support rollers 14 and 15 are four image forming units 1Y, 1M, 1C, and 1K being aligned in the rotation direction D10 of the intermediate transfer belt 10 and constituting the tandem image forming device 20. Suffixes Y, M, C, and K represent yellow, magenta, cyan, and black, respectively. The image forming units 1Y, 1M, 1C, and 1K include photoconductive drums 2Y, 2M, 2C, and 2K serving as image bearers that bear yellow, magenta, cyan, and black toner images, respectively. When forming a black toner image on the intermediate transfer belt 10, the support rollers 15 and 15' move to isolate the intermediate transfer belt 10 from the photoconductive drums 2Y, 2M, and 2C.

Above the image forming device 20 is two exposure devices 4. The left exposure device 4 corresponds to the two image forming units 1Y and 1M. The right exposure device 4 corresponds to the two image forming units 1C and 1K. The exposure device 4 employs an optical scanning method and includes two light sources (e.g., a semiconductor laser, a semiconductor laser array, or a multi-beam light source), a coupling optical system, a common optical deflector (e.g., a polygon mirror), and two scanning-image forming optical systems. The exposure devices 4 expose the photoconductive drums 2Y, 2M, 2C, and 2K according to yellow, magenta, cyan, and black image data, forming electrostatic latent images on the photoconductive drums 2Y, 2M, 2C, and 2K, respectively.

Each of the photoconductive drums 2Y, 2M, 2C, and 2K is surrounded by a developing device that visualizes the electrostatic latent image into a visible toner image, that is, yellow, magenta, cyan, and black toner images, and other components. Since the yellow, magenta, cyan, and black toner images are formed through general image forming processes, a detailed description of the image forming processes is omitted. Primary transfer rollers 6Y, 6M, 6C, and 6K are disposed opposite the photoconductive drums 2Y, 2M, 2C, and 2K via the intermediate transfer belt 10 to form primary transfer nips between the photoconductive drums 2Y, 2M, 2C, and 2K and the intermediate transfer belt 10, respectively, where the yellow, magenta, cyan, and black toner images formed on the photoconductive drums 2Y, 2M, 2C, and 2K are primarily transferred onto the intermediate transfer belt 10 as a color toner image.

A secondary transfer device 22 is disposed opposite the image forming device 20 via the intermediate transfer belt 10. The secondary transfer device 22 includes a secondary transfer roller 16' pressed against the support roller 16 serving as a secondary transfer opposed roller via the intermediate transfer belt 10. The secondary transfer roller 16' generates a transfer electric field to secondarily transfer the color toner image formed on the intermediate transfer belt 10 onto a sheet S (e.g., a transfer sheet) serving as a recording medium conveyed from a paper tray 43.

Downstream from the secondary transfer device 22 in a sheet conveyance direction DS is a fixing device 25 (e.g., a fuser or a fusing unit) that fixes the color toner image transferred from the intermediate transfer belt 10 onto the sheet S thereon. The fixing device 25 includes an endless fixing belt 26 and a pressure roller 27 pressed against the fixing belt 26. The fixing belt 26 is looped over two support rollers. A heater (e.g., a lamp or an induction heater employing an electromagnetic induction heating method) is disposed inside one of the support rollers.

A conveyance belt 24 supported by two rollers 23 conveys the sheet S bearing the color toner image transferred from the intermediate transfer belt 10 to the fixing device 25. Instead of the conveyance belt 24, a stationary guide, a conveyance roller, or the like may be used.

Below the secondary transfer device 22 and the fixing device 25 is a sheet reverse device 28 disposed in parallelism with the image forming device 20. The sheet reverse device 28 reverses and conveys the sheet S for duplex printing to print another toner image on a back side of the sheet S.

A description is provided of a construction of the fixing device 25 incorporated in the image forming apparatus 1000 having the construction described above.

Figure 2:
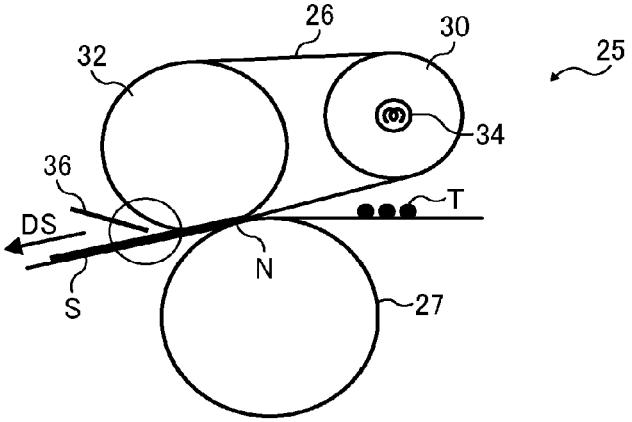
FIG. 2 is a schematic vertical sectional view of a fixing device according to a first exemplary embodiment of the present disclosure, which is installed in the image forming apparatus shown in FIG. 1.

FIG. 2 is a schematic vertical sectional view of the fixing device 25. As shown in FIG. 2, the fixing device 25 includes a heating roller 30, a fixing roller 32, the fixing belt 26 being stretched taut across the heating roller 30 and the fixing roller 32 and facing a toner image T on a sheet S, the pressure roller 27 pressed against the fixing roller 32 via the fixing belt 26 to form a fixing nip N between the fixing belt 26 and the pressure roller 27, and a separation plate 36 disposed downstream from the fixing nip N in the sheet conveyance direction DS. The fixing roller 32 or the fixing belt 26 serves as a first rotator. The pressure roller 27 serves as a second rotator.

A detailed description is now given of a construction of the fixing belt 26.

The fixing belt 26 is a multi-layer endless belt constructed of a base layer, an elastic layer coating the base layer, and a release layer coating the elastic layer. The base layer, having a layer thickness of about 90 micrometers, is made of polyimide (PI) resin. The elastic layer is made of silicone rubber or the like. The elastic layer, having a layer thickness in a range of from about 200 micrometers to about 500 micrometers, is made of an elastic material such as silicone rubber, fluoro rubber, and silicone rubber foam. The release layer, having a layer thickness of about 20 micrometers, is made of tetrafluoroethylene-perfluoroalkylvinylether copolymer (PFA), polyimide (PI), polyether imide (PEI), polyether sulfide (PES), or the like. The release layer serving as a surface layer of the fixing belt 26 facilitates separation or peeling-off of toner of the toner image T on the sheet S from the fixing belt 26.

A detailed description is now given of a construction of the heating roller 30, the fixing roller 32, and the pressure roller 27.

The heating roller 30 is a thin tube made of metal, for example. Each of the fixing roller 32 and the pressure roller 27 is a tube constructed of a cored bar made of metal and an elastic layer coating the cored bar and made of fluoro rubber, silicone rubber, silicone rubber foam, or the like. At least the heating roller 30 accommodates a heater 34 serving as a heater or a heat source. The heating roller 30 heats the fixing belt 26 which in turn heats the sheet S bearing the unfixed toner image T while the sheet S contacts an outer circumferential surface of the fixing belt 26, thus fixing the toner image T on the sheet S.

A description is provided of a configuration of a comparative fixing device incorporating a mechanism to separate a sheet ejected from a fixing nip formed between a fixing rotator and a pressure rotator from the fixing rotator.

The comparative fixing device includes a separator (e.g., a separation claw and a separation plate) disposed in proximity to an exit of the fixing nip to separate the sheet from the fixing rotator. Hence, as toner of a toner image formed on the sheet, while it retains heat received from the fixing rotator, comes into contact with the separator, half melted toner on the sheet may slide over the separator which damages the toner image on the sheet.

To address this circumstance, the separator may include a plurality of separation plates having front edges aligned in parallelism with an axial direction of the fixing rotator. A positioner disposed at each lateral end of the separator abuts the fixing rotator in a non-conveyance span on the fixing rotator where the sheet is not conveyed. An adjuster adjusts a gap between the front edge of the separation plate and the fixing rotator to be constant.

However, since an interval is provided between the adjacent separation plates, the sheet of a type susceptible to deformation may strike the separation plate with substantial impact, causing failures such as gloss streaks or scratches on the toner image on the sheet and creases on the sheet. To address this circumstance, the number of the separation plates may be increased. However, it takes substantial time to adjust the gap between each separation plate and the fixing rotator.

Alternatively, the separator may include a single plate extending in a longitudinal direction perpendicular to a sheet conveyance direction. However, the gap between each separation plate and the fixing rotator may increase to enhance precision of components, degrading separation of the sheet having a decreased leading margin from the fixing rotator. Additionally, as the fixing rotator expands thermally, the sheet may not strike the separator with even pressure, degrading the toner image on the sheet.

Figure 3A:
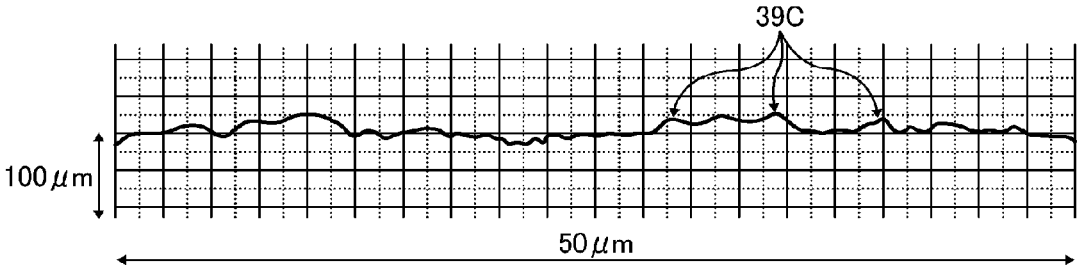
FIG. 3A is a diagram showing a front end profile in a direction perpendicular to a surface of a separator of a comparative fixing device.
Figure 3B:
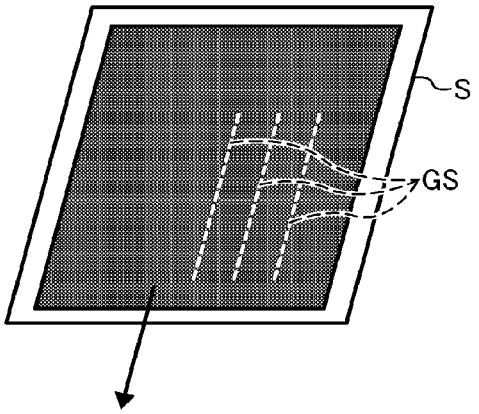
FIG. 3B is a perspective view of a sheet illustrating gloss streaks thereon produced by peculiar projections on the separator shown in FIG. 3A.

Regardless of whether the separator includes the single separation plate or the plurality of separation claws, each of which has the decreased width, the front end of the separator of the comparative fixing device may have local peculiar projections 39C as shown in FIG. 3A within variation in processing. FIG. 3A is a diagram showing a front end profile in a direction perpendicular to a surface of the sheet of the separator of the comparative fixing device. As a solid toner image on a sheet S strikes the peculiar projections 39C with substantial impact, the peculiar projections 39C may produce gloss streaks and scratches on the solid toner image on the sheet S as shown in FIG. 3B. FIG. 3B is a perspective view of the sheet S illustrating gloss streaks GS thereon produced by the peculiar projections 39C. Even if the front end of the separator is processed with increased precision and a surface of a front edge of the separator is smoothed, the sheet S may slide over the separator with an increased friction therebetween and may be caught in a gap between the separator and the fixing rotator, thus being jammed between the separator and the fixing rotator.

A detailed description is now given of a construction of the separation plate 36 incorporated in the fixing device 25 depicted in FIG. 2.

The separation plate 36, serving as a separator or a recording medium separator, is disposed downstream from the fixing nip N in the sheet conveyance direction DS and disposed opposite the fixing roller 32 via the fixing belt 26. As the sheet S is ejected from the fixing nip N, the separation plate 36 separates a leading end of the sheet S from the fixing belt 26. The sheet S is conveyed to an output tray located outside the body 100 of the image forming apparatus 1000 or the sheet reverse device 28 depicted in FIG. 1. Optionally, another separation plate may be disposed opposite the pressure roller 27.

The separation plate 36 may include a plurality of separation claws, each of which has a decreased width in a longitudinal direction of the separation plate 36 perpendicular to the sheet conveyance direction DS, arranged in parallelism with each other. However, in order to allow the separation plate 36 to contact the sheet S evenly, the separation plate 36 includes a single plate extending in the longitudinal direction of the separation plate 36. The separation plate 36 has a length in the longitudinal direction thereof that is greater than a conveyance span (e.g., a maximum image span) on the fixing belt 26 in an axial direction thereof parallel to the longitudinal direction of the separation plate 36 where the sheet S is conveyed. In order to address disadvantages of a single plate, the separation plate 36 has a construction described below.

Figure 4:
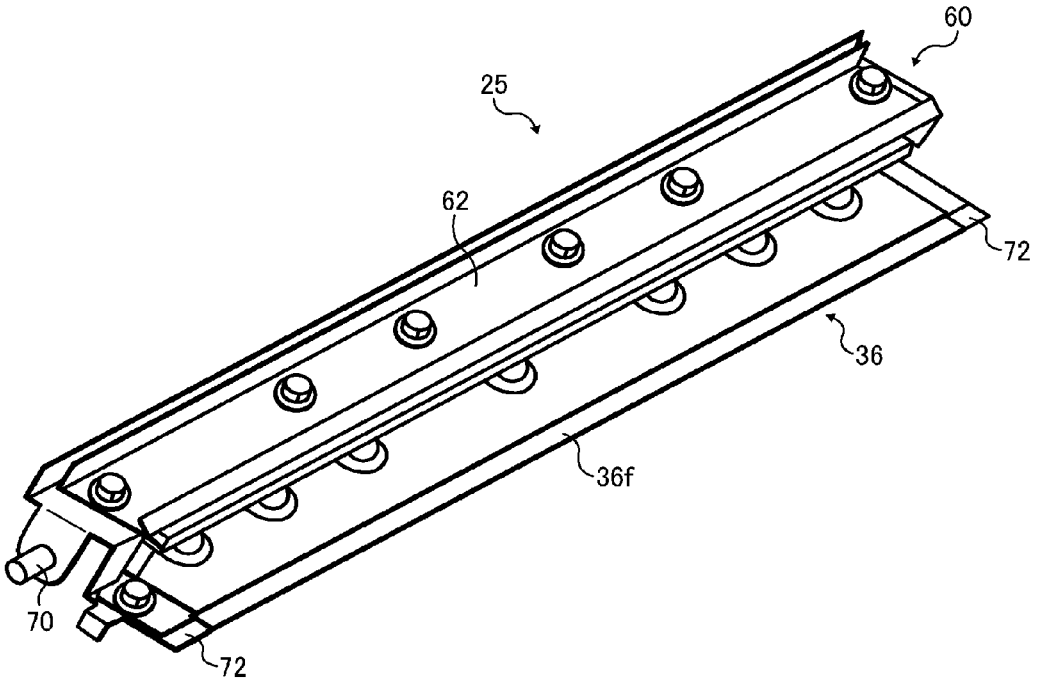
FIG. 4 is a partial perspective view of the fixing device shown in FIG. 2 illustrating a separation device incorporated therein.
Figure 5:
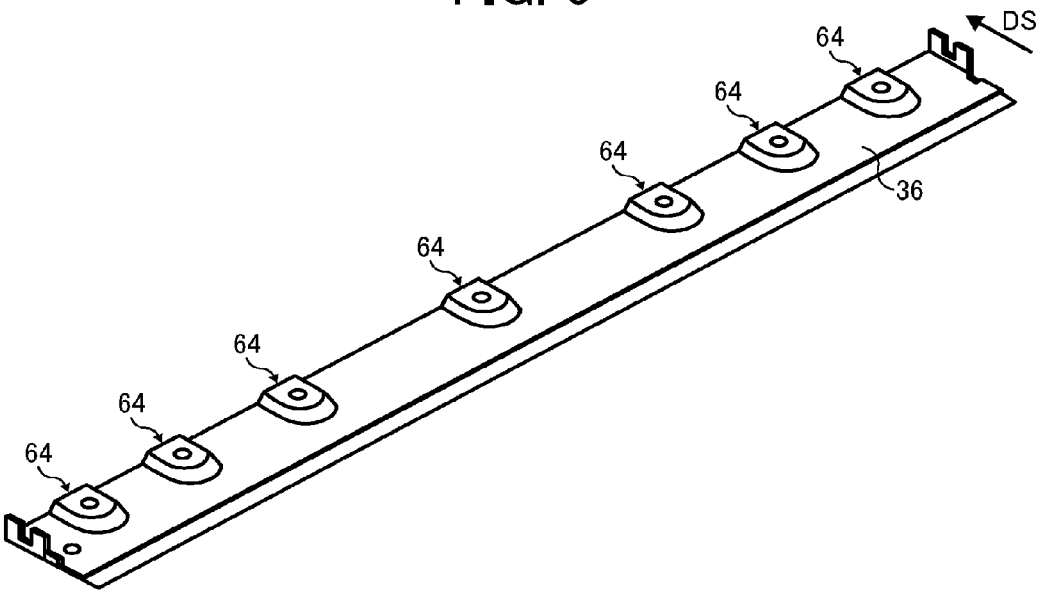
FIG. 5 is a perspective view of a separation plate incorporated in the fixing device shown in FIG. 4.
Figure 6:
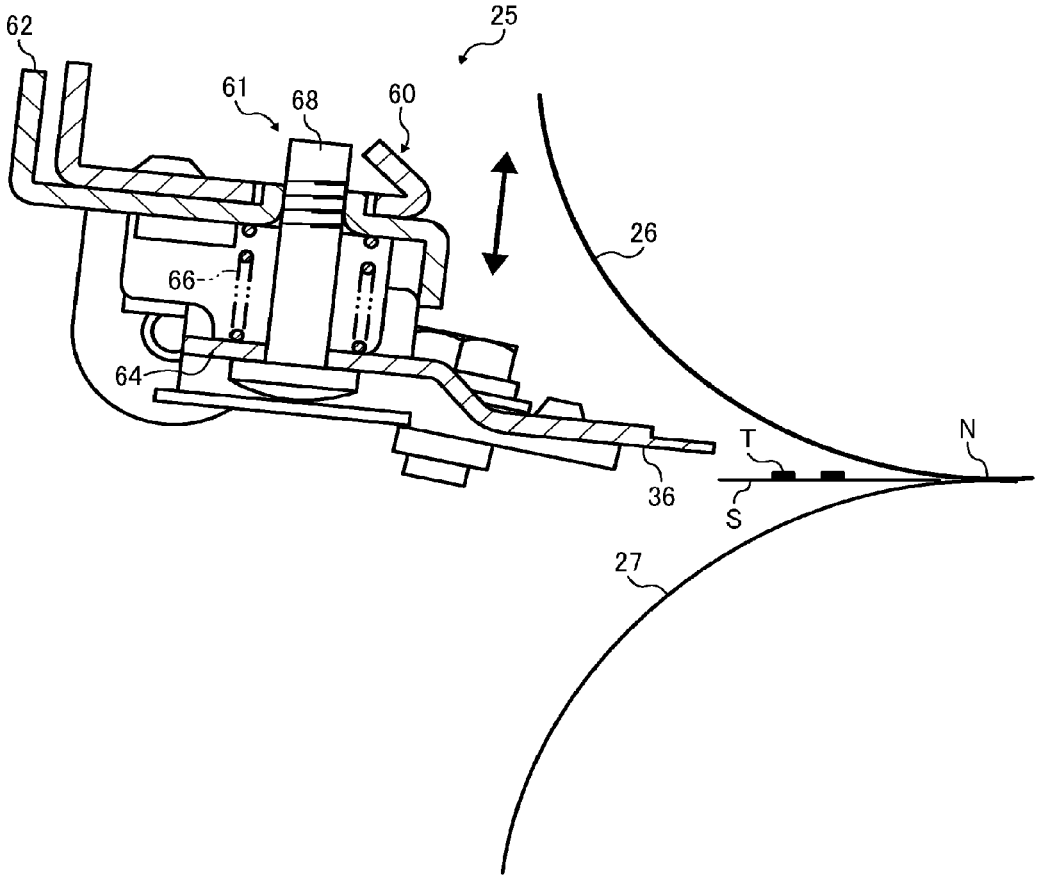
FIG. 6 is a sectional view of the separation device shown in FIG. 4.

FIG. 4 is a partial perspective view of the fixing device 25. As shown in FIG. 4, the separation plate 36, that is, a single plate, is attached to a stay 62 serving as a support. FIG. 5 is a perspective view of the separation plate 36. As shown in FIG. 5, the separation plate 36 includes a plurality of projections 64 disposed in a downstream end of the separation plate 36 in the sheet conveyance direction DS. Thus, the separation plate 36, the stay 62, and the projections 64 constitute a separation device 60 serving as a recording medium separation device. FIG. 6 is a sectional view of the separation device 60. As shown in FIG. 6, the projections 64 project in a direction in which the projections 64 separate from a conveyance path where the sheet S is conveyed.

Figure 7:
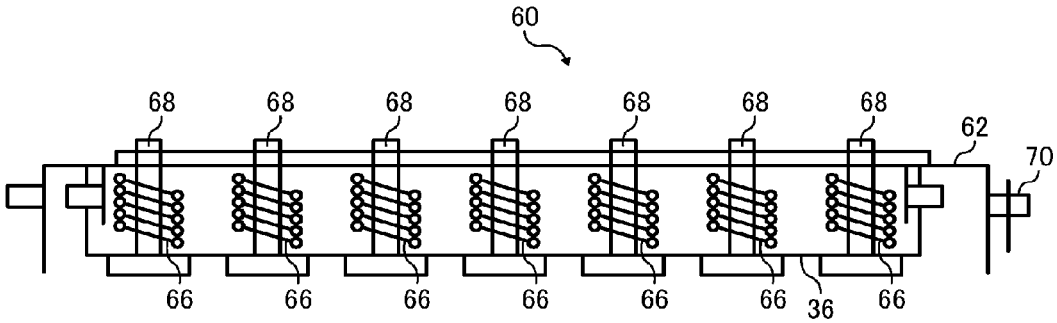
FIG. 7 is a side view of the separation device shown in FIG. 6.

The separation device 60 further includes a position adjuster 61 interposed between the stay 62 and each of the projections 64 mounted on the separation plate 36. The position adjuster 61 includes a spring 66 and a screw 68. FIG. 7 is a side view of the separation device 60. As shown in FIGS. 4 and 7, as a positioning pin 70 swaged in the stay 62 is inserted into a through-hole of a frame of the fixing device 25, the separation device 60 is held by and positioned inside the fixing device 25. As shown in FIG. 4, an abutment plate 72 is contiguous to each lateral end of the separation plate 36 in the longitudinal direction thereof and disposed opposite a non-conveyance span on the fixing belt 26 where the sheet S is not conveyed. A front edge of the abutment plate 72 contacts the fixing belt 26 to position the separation plate 36 with respect to the fixing belt 26.

Figure 8:
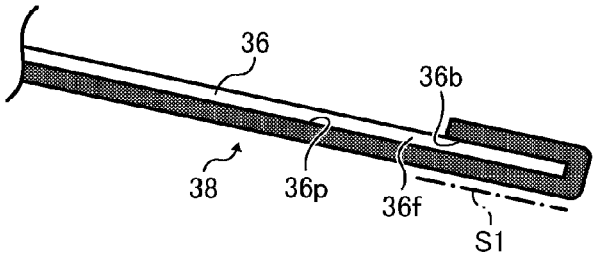
FIG. 8 is a partial sectional view of the separation plate shown in FIG. 5.

The separation plate 36 is a metal plate made of heat resistant plastic or SUS stainless steel. The separation plate 36 includes a thin sheet, that is, a sheet-shaped front end 36*f*, having a thickness of about 0.4 mm, for example, to reduce a gap between the separation plate 36 and the fixing nip N. FIG. 8 is a partial sectional view of the separation plate 36. As shown in FIG. 8, a tape 38 coats the front end 36*f* of the separation plate 36 such that the tape 38 is folded at a front edge of the separation plate 36 to cover a conveyance path side face 36*p* and a fixing belt side face 36*b* of the separation plate 36. The tape 38 is adhered to the separation plate 36, thus serving as a surface layer mounted on the separation plate 36. The tape 38 is made of fluoroplastic such as Teflon® that facilitates sliding of the sheet S over the tape 38 and separation of the sheet S from the tape 38. A combined thickness of the tape 38 and the front end 36*f* of the separation plate 36 is suppressed to about 0.6 mm, thus facilitating reduction of the gap between the separation plate 36 and the fixing nip N.

Figure 9A:
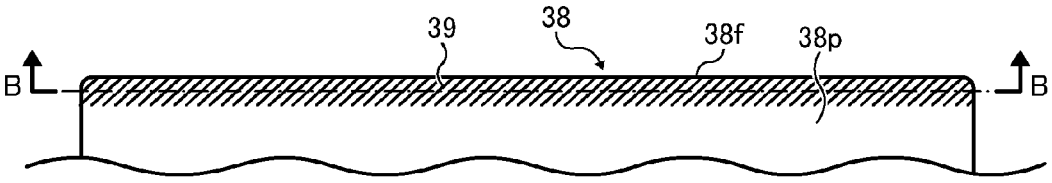
FIG. 9A is a partial plan view of a tape mounted on the separation plate shown in FIG. 8.

FIG. 9A is a partial plan view of the tape 38. As shown in FIG. 9A, a front end 38*f* of a conveyance path side face 38*p* of the tape 38 is provided with a plurality of slight recesses 39 aligned obliquely with each other regularly in at least a conveyance span on the tape 38 where the sheet S is conveyed. Each recess 39 extends to a front edge of the conveyance path side face 38*p* of the tape 38. Each recess 39 is a depression defined by a front wall being disposed opposite the fixing nip N and having a decreased height and other three walls having an increased height. The low front wall of the recess 39 may have one or more steps. The plurality of slight recesses 39 situated at the front end 36*f* of the separation plate 36 depicted in FIG. 8 reduces friction between the sheet S and the separation plate 36 while the separation plate 36 separates the sheet S ejected from the fixing nip N from the fixing belt 26, thus improving conveyance of the sheet S.

Figure 9B:
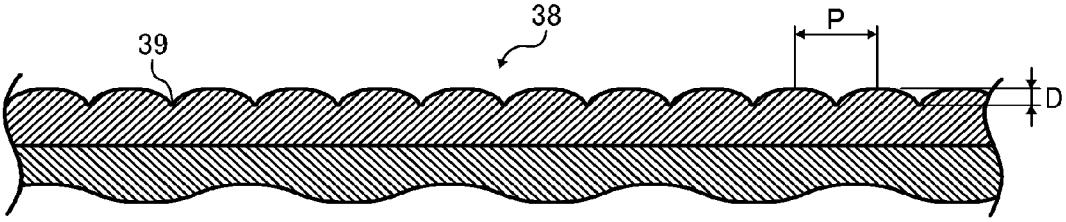
FIG. 9B is a partial sectional view of the tape taken on line B-B in FIG. 9A.

FIG. 9B is a partial sectional view of the tape 38 taken on line B-B in FIG. 9A. The recess 39 is regularly aligned with the adjacent recess 39 with a pitch not greater than 1 mm in the front end 38*f* of the conveyance path side face 38*p* of the tape 38. The recesses 39 are treated with or processed by deburring press, eliminating peculiar projections. Accordingly, the recesses 39 prevent the sheet S from contacting the separation plate 36 partially, suppressing formation of gloss streaks on the toner image T on the sheet S. According to this exemplary embodiment, the recess 39 is aligned with the adjacent recess 39 with a pitch P of 0.5 mm therebetween as shown in FIG. 9B. If the pitch is greater than 1 mm, the recesses 39 may produce image streaks aligned with each other with the pitch of 1 mm on the toner image T on the sheet S. Conversely, if the pitch is not greater than 1 mm, the recesses 39 do not cause image failure. The recesses 39 aligned with the pitch of 1 mm produce a depression of 0.5 mm and a projection of 0.5 mm in cross-section. Alternatively, the recesses 39 may produce a depression of 0.25 mm and a projection of 0.75 mm in cross-section or a depression of 0.75 mm and a projection of 0.25 mm.

The recess 39 has a depth not smaller than 5 micrometers. According to this exemplary embodiment, the recess 39 has a depth D of about 20 micrometers (e.g., 20 micrometers plus and minus 5 micrometers). It is to be noted that the recess 39 shown in FIG. 9B is not illustrated in a proportional scale between a vertical and a horizontal. A bottom or a trough of the recess 39 may thermally expand into a bulge under heat from the fixing belt 26. To address this circumstance, the recess 39 has the depth D not smaller than 5 micrometers to retain an appropriate recess shape even when the recess 39 is subject to thermal expansion. Accordingly, the recess 39 may have the depth D of 50 micrometers, for example. Alternatively, the slight recesses 39 may be produced in the separation plate 36 directly, not by attaching the tape 38 to the separation plate 36.

Figure 10:
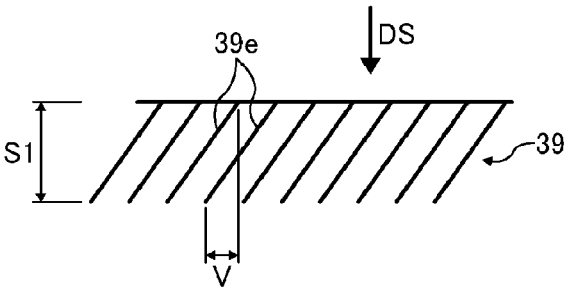
FIG. 10 is a partial plan view of recesses disposed on the tape shown in FIG. 9A.

FIG. 10 is a partial plan view of the recesses 39. As shown in FIG. 10, each of the recesses 39 extends obliquely relative to the sheet conveyance direction DS in an extension line 39*e*. For example, the extension line 39*e* of a first recess 39 and the extension line 39*e* of a second recess 39 adjacent to the first recess 39 overlap in a direction perpendicular to the sheet conveyance direction DS to define an overlap span V. The extension line 39*e* defines a line produced on the tape 38 or a surface of the separation plate 36 by the recess 39 disposed on the front end 36*f* of the separation plate 36. The extension lines 39*e* of the recesses 39 extending obliquely relative to the sheet conveyance direction DS bring the plurality of projections, each of which is between the adjacent extension lines 39*e*, into contact with the sheet S evenly, preventing formation of pitch streaks on the toner image T on the sheet S. Each of the recesses 39 is inclined relative to the sheet conveyance direction DS by 30 degrees, 45 degrees, or 60 degrees. However, the adjacent recesses 39 overlap in the overlap span V in the direction perpendicular to the sheet conveyance direction DS.

The recesses 39 are disposed in the front end 38*f* on the conveyance path side face 38*p* of the tape 38 depicted in FIG. 9A in a recess span S1 in the sheet conveyance direction DS depicted in FIG. 10. FIG. 8 illustrates the recess span S1 in the dashed line on the tape 38 adhered to the separation plate 36. The recess span S1 spans from the front edge of the separation plate 36 disposed opposite the fixing nip N to a position distanced from the front edge of the separation plate 36 in the sheet conveyance direction DS by 2 mm, 5 mm, or more. The recesses 39 are formed in oblique lines as shown in FIG. 10. Alternatively, the recesses 39 may be formed in a wave, a V-shape, an X-shape, or a C-shape, for example.

Figure 11:
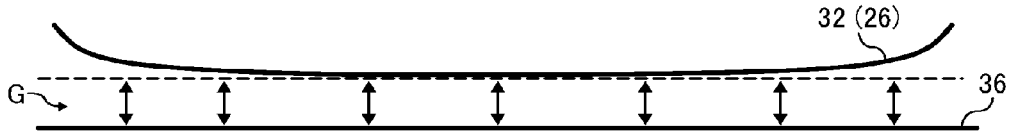
FIG. 11 is a plan view of the separation plate, a fixing belt, and a fixing roller incorporated in the fixing device shown in FIG. 2 when a sheet is centered in an axial direction of the fixing belt.
Figure 12:
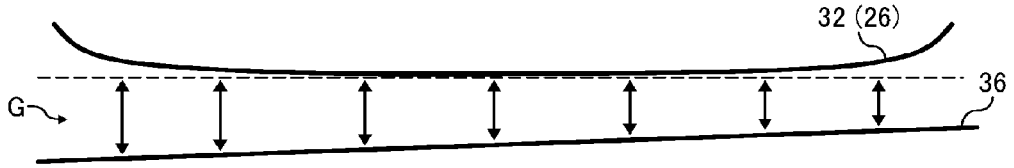
FIG. 12 is a plan view of the separation plate, the fixing belt, and the fixing roller incorporated in the fixing device shown in FIG. 2 when the sheet is aligned at one lateral edge of the fixing belt in the axial direction thereof.

FIG. 11 is a plan view of the separation plate 36, the fixing belt 26, and the fixing roller 32 when the sheet S is centered in the axial direction of the fixing belt 26 in a center conveyance method. FIG. 12 is a plan view of the separation plate 36, the fixing belt 26, and the fixing roller 32 when the sheet S is aligned at one lateral edge of the fixing belt 26 in the axial direction thereof in a lateral edge conveyance method.

In the image forming apparatus 1000 employing the center conveyance method in which the sheet S is centered on the fixing belt 26 in the axial direction thereof as the sheet S is conveyed over the fixing belt 26 as shown in FIG. 11, the separation plate 36 is installed in the fixing device 25 such that a gap G between the front edge of the separation plate 36 and the fixing belt 26 increases from a center to each lateral end of the separation plate 36 in the longitudinal direction thereof. An external form of the fixing roller 32 is subject to thermal expansion. To address this circumstance, thermal expansion of the fixing roller 32 is measured with a laser displacement meter in advance during design evaluation.

When the sheet S is centered on the fixing belt 26 in the axial direction thereof, a center of the fixing roller 32 in an axial direction thereof may thermally expand substantially. To address this circumstance, the front edge of the separation plate 36 is retained in parallelism with the axial direction of the fixing roller 32. Conversely, when the sheet S is aligned at one lateral edge on the fixing belt 26 in the axial direction thereof while the sheet S is conveyed over the fixing belt 26, a lateral end of the fixing roller 32 in the axial direction thereof may thermally expand substantially. To address this circumstance, the front edge of the separation plate 36 is retained in inclination with the axial direction of the fixing roller 32 as shown in FIG. 12.

A description is provided of a method for manufacturing slight recesses 39 on the front end 36*f* on the conveyance path side face 36*p* of the separation plate 36 at least in a conveyance span in the longitudinal direction of the separation plate 36 where the sheet S is conveyed over the separation plate 36.

Figure 13:
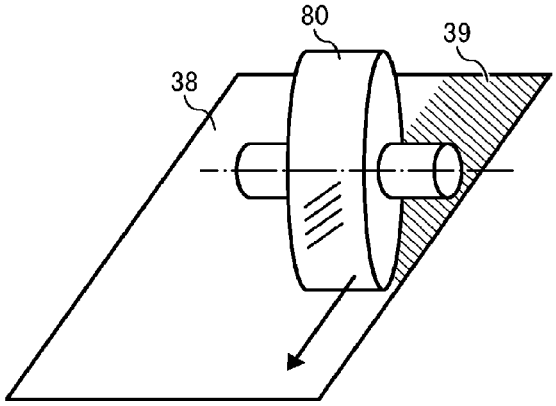
FIG. 13 is a perspective view of the tape shown in FIG. 9A.

FIG. 13 is a perspective view of the tape 38. As shown in FIG. 13, before the tape 38 is adhered to the separation plate 36, a specialized tool 80 transfers recesses onto the tape 38 by deburring press. Thus, peculiar projections are produced as the tape 38 is adhered to the separation plate 36, facilitating processing of the recesses 39. For example, the specialized tool 80 is a metal tube having an outer circumferential face mounting a plurality of projections extending regularly and obliquely in a teeth shape. For example, a knurling tool (e.g., a knurled roller) or the like that is commercially available to make knurls is used as the specialized tool 80.

Figure 14:
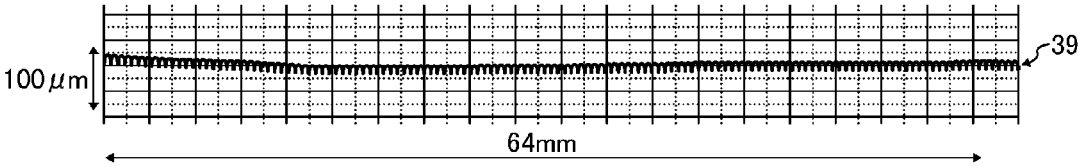
FIG. 14 is a diagram showing a front end profile for the recesses shown in FIG. 10.

FIG. 14 is a diagram showing a front end profile in a direction perpendicular to a surface of the sheet S for the slight recesses 39 on the front end 36*f* on the conveyance path side face 36*p* of the separation plate 36 of the separation device 60 at least in the conveyance span in the longitudinal direction of the separation plate 36 where the sheet S is conveyed over the separation plate 36. As shown in FIG. 3A, the separation plate of the comparative fixing device has the peculiar projections 39C. Conversely, as shown in FIG. 14, the recesses 39 of the fixing device 25 do not have peculiar projections.

A description is provided of a configuration of a fixing device 25S according to a second exemplary embodiment.

Figure 15:
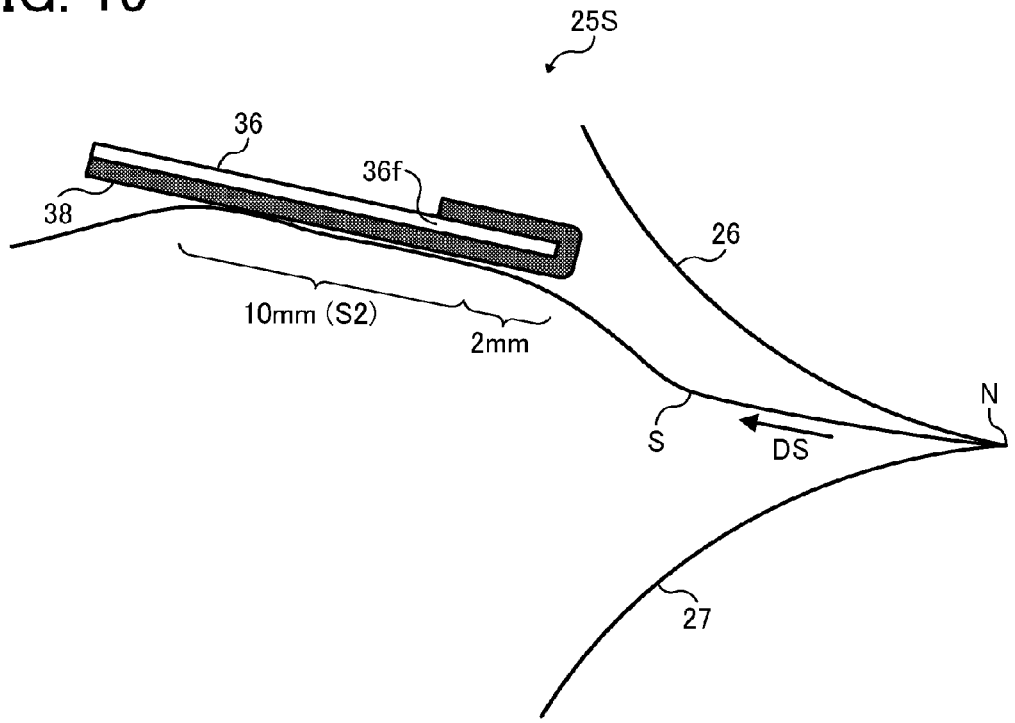
FIG. 15 is a partial sectional view of a fixing device according to a second exemplary embodiment of the present disclosure.

FIG. 15 is a partial sectional view of the fixing device 25S. The fixing device 25S has the configuration to prevent a solid toner image on a sheet S from adhering to the separation plate 36 as the sheet S is ejected from fixing nip N and separated from the fixing belt 26. It is to be noted that the configuration of the fixing device 25S that is different from the configuration of the fixing device 25 depicted in FIG. 2 is described below. Identical reference numerals are assigned to components of the fixing device 25S that are identical to the components of the fixing device 25 and a description of those components is omitted.

FIG. 15 illustrates a recess span S2, that is, a contact span on the tape 38 adhered to the separation plate 36 where the sheet S contacts the separation plate 36. The recess span S2 spans from an upstream position distanced from the front edge of the separation plate 36 disposed opposite the fixing nip N by 2 mm to a downstream position distanced from the front edge of the separation plate 36 by 12 mm in the sheet conveyance direction DS.

The separation plate 36 is a metal plate made of heat resistant plastic or SUS stainless steel. The separation plate 36 includes a thin sheet, that is, the sheet-shaped front end 36*f*, having a thickness of about 0.4 mm, for example, to reduce a gap between the separation plate 36 and the fixing nip N.

Figure 16:
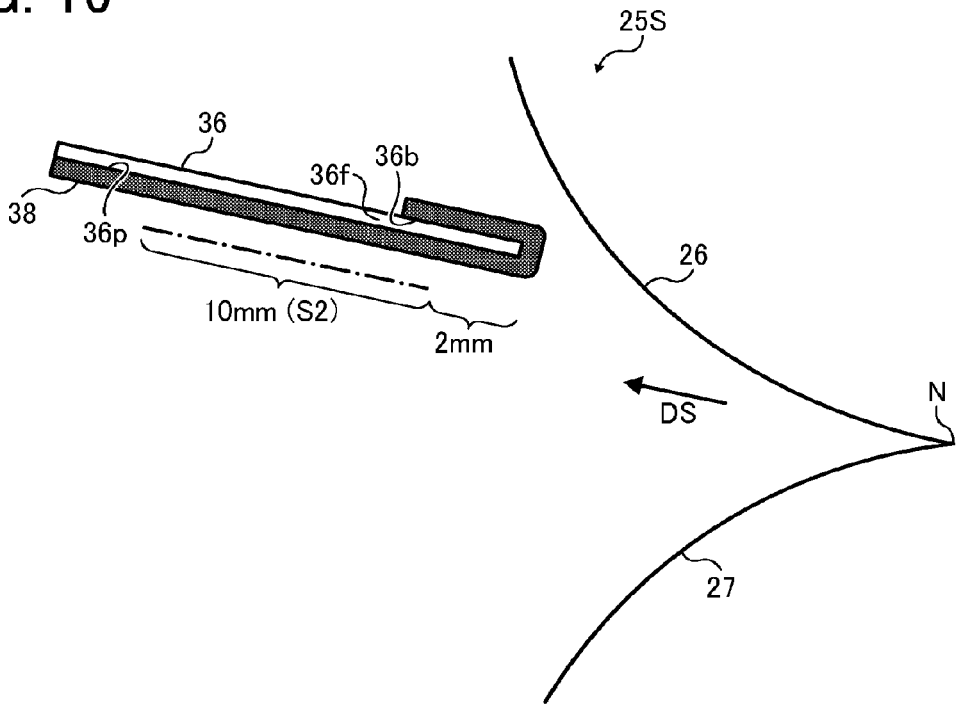
FIG. 16 is a partial sectional view of the separation plate and the tape incorporated in the fixing device shown in FIG. 15.
Figure 17:
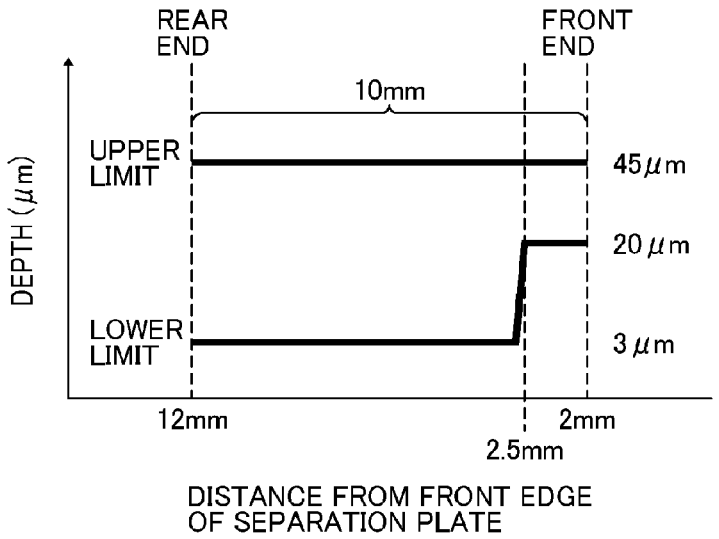
FIG. 17 is a graph showing a relation between the position of the separation plate and the depth of the recess of the fixing device shown in FIG. 15.

FIG. 16 is a partial sectional view of the separation plate 36 and the tape 38. FIG. 16 illustrates the recess span S2 in a dashed line. As shown in FIG. 16, the tape 38 coats the front end 36*f* of the separation plate 36 such that the tape 38 is folded at the front edge of the separation plate 36 to cover the conveyance path side face 36*p* and the fixing belt side face 36*b* of the separation plate 36. The tape 38 is adhered to the separation plate 36, thus serving as a surface layer of the separation plate 36. The tape 38 is made of fluoroplastic such as Teflon® that facilitates sliding of the sheet S over the tape 38 and separation of the sheet S from the tape 38. A combined thickness of the tape 38 and the front end 36*f* of the separation plate 36 is suppressed to about 0.6 mm, thus facilitating reduction of the gap between the separation plate 36 and the fixing nip N. As shown in FIGS. 9A, 16, and 17, the front end 38*f* on the conveyance path side face 38*p* of the tape 38 is provided with the plurality of slight recesses 39 aligned obliquely with each other regularly in the recess span S2 at least in the conveyance span on the front end 38*f* of the tape 38 where the sheet S is conveyed. The front end 38*f* on the conveyance path side face 38*p* of the tape 38 is provided with the plurality of slight recesses 39 in the recess span S2 defined between the upstream position distanced from the front edge of the tape 38 by 2 mm and the downstream position distanced from the front edge of the tape 38 by 12 mm in the sheet conveyance direction DS.

FIG. 17 is a graph showing a relation between the position of the separation plate 36 and the depth of the recess 39. FIG. 17 illustrates a relation between the distance from the front edge of the separation plate 36 in the sheet conveyance direction DS and the depth of the recess 39. The recesses 39 include a front recess 39 and a rear recess 39 extending from the front recess 39 and disposed downstream from the front recess 39 in the sheet conveyance direction DS. The front recess 39 situated in a front span defined between an upstream position distanced from the front edge of the separation plate 36 by 2.0 mm and a downstream position distanced from the front edge of the separation plate 36 by 2.5 mm in the sheet conveyance direction DS has a depth in a range of from 20 micrometers to 45 micrometers. The rear recess 39 situated in a rear span defined between an upstream position distanced from the front edge of the separation plate 36 by 2.5 mm and a downstream position distanced from the front edge of the separation plate 36 by 12.0 mm in the sheet conveyance direction DS has a depth in a range of from 3 micrometers to 45 micrometers.

The front recess 39 situated at a position in the front span is susceptible to adhesion of the sheet S to the separation plate 36 compared to the recesses 39 situated at other positions because the sheet S comes into contact with the separation plate 36 with an increased force. To address this circumstance, the front recess 39 situated at the position in the front span has a lower limit of the depth of 20 micrometers that is greater than a lower limit of the recesses 39 at other positions. The plurality of slight recesses 39 situated at the front end 36*f* of the separation plate 36 depicted in FIG. 9B reduces friction between the sheet S and the separation plate 36 while the separation plate 36 separates the sheet S ejected from the fixing nip N from the fixing belt 26, thus improving conveyance of the sheet S.

The recess 39 has an upper limit of the depth of 45 micrometers. If the upper limit is greater than 45 micrometers, when the tape 38 is broken or cut during processing, a projection and a depression of the recess 39 may produce a gloss streak.

To address this circumstance, in order to increase the depth of the recess 39, the pitch between the adjacent depressions is in a range of from about 0.8 mm to about 1.2 mm. If the pitch between the adjacent projections increases, the toner image T on the sheet S is susceptible to formation of a gloss streak. However, as a relative distance from an exit of the fixing nip N to the separation plate 36 increases as in this exemplary embodiment, the sheet S slides over the separation plate 36 with a decreased friction therebetween, reducing the gloss streak.

A description is provided of a method for manufacturing the slight recesses 39 on the front end 36*f* on the conveyance path side face 36*p* of the separation plate 36 at least in the conveyance span in the longitudinal direction of the separation plate 36 where the sheet S is conveyed over the separation plate 36.

Before the tape 38 is adhered to the separation plate 36, the specialized tool 80 depicted in FIG. 13 transfers recesses onto the tape 38 by deburring press. Thus, peculiar projections are produced as the tape 38 is adhered to the separation plate 36, facilitating processing of the recesses 39. For example, the specialized tool 80 is the metal tube having the outer circumferential face mounting the plurality of projections extending regularly and obliquely in the teeth shape. For example, the knurling tool (e.g., the knurled roller) or the like that is commercially available to make knurls is used as the specialized tool 80. Alternatively, the slight recesses 39 may be produced in the separation plate 36 directly, not by attaching the tape 38 to the separation plate 36.

Figure 18:
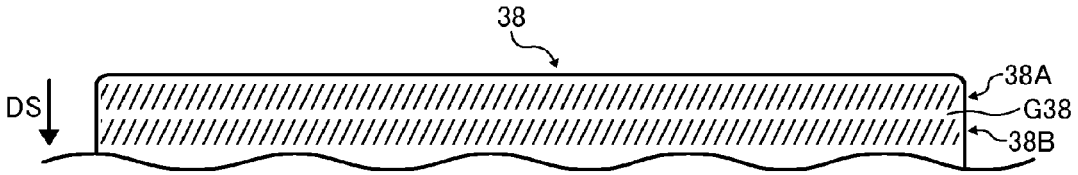
FIG. 18 is a partial plan view of the tape shown in FIG. 16 illustrating an arrangement of the recesses.

FIG. 18 is a partial plan view of the tape 38. The commercially available knurling tool has a width of 5 mm. In order to process knurls having a width of 10 mm in the sheet conveyance direction DS with the knurling tool having the width of 5 mm, a first process is performed on a first band 38A disposed in proximity to or distanced from the front edge of the separation plate 36 by a predetermined length and a second process is performed on a second band 38B adjacent to and downstream from the first band 38A in the sheet conveyance direction DS. Thus, knurls having the width of 10 mm are produced. Even if a slight gap G38 is produced between the first band 38A having the width of 5 mm and the second band 38B having the width of 5 mm, the gap G38 does not adversely affect conveyance of the sheet S and quality of the toner image T formed on the sheet S.

Figure 19:
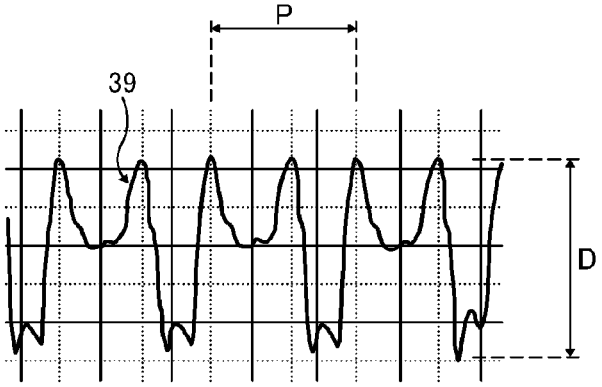
FIG. 19 is a diagram showing a profile for the recesses disposed on the tape shown in FIG. 16 and processed by knurling.

FIG. 19 is a diagram showing a profile of the recesses 39 processed by knurling. As shown in FIG. 19, the adjacent recesses 39 are aligned with the pitch P of 1 mm therebetween and each of the recesses 39 has the depth D of 20 micrometers. Even if the recesses 39 are contoured as shown in FIG. 9B with the profile depicted in FIG. 19, the recesses 39 do not adversely affect conveyance of the sheet S and quality of the toner image T formed on the sheet S.

According to this exemplary embodiment, in the conveyance path where the sheet S ejected from the fixing nip N is conveyed while the sheet S contacts the separation plate 36 as shown in FIG. 15, the plurality of recesses 39 is disposed in the recess span S2 spanning from the upstream position distanced from the front edge of the separation plate 36 disposed opposite the fixing nip N by a predetermined first length of 2 mm to the downstream position distanced from the front edge of the separation plate 36 by a predetermined second length of 12 mm in the sheet conveyance direction DS on the conveyance path side face 36*p* of the separation plate 36 depicted in FIG. 16 at least in the conveyance span on the separation plate 36 where the sheet S is conveyed over the separation plate 36. Accordingly, the recesses 39 reduce the area of the separation plate 36 where the separation plate 36 contacts the sheet S to separate the sheet S from the fixing belt 26 while the separation plate 36 suppresses friction between the separation plate 36 and the sheet S as the sheet S slides over the separation plate 36. Consequently, the recesses 39 prevent the sheet S from being jammed by the separation plate 36 and prevent gloss streaks from appearing on the toner image T on the sheet S.

As shown in FIG. 10, each of the recesses 39 extends obliquely relative to the sheet conveyance direction DS in the extension line 39*e*. For example, the extension line 39*e* of the first recess 39 and the extension line 39*e* of the second recess 39 adjacent to the first recess 39 overlap in the direction perpendicular to the sheet conveyance direction DS in the overlap span V. Accordingly, the recesses 39 do not mark projections and depressions on a part of the toner image T on the sheet S. It is to be noted that the values mentioned above are examples and do not limit the configurations according to the exemplary embodiments described above.

A description is provided of a construction of another image forming apparatus 1000S.

Figure 20:
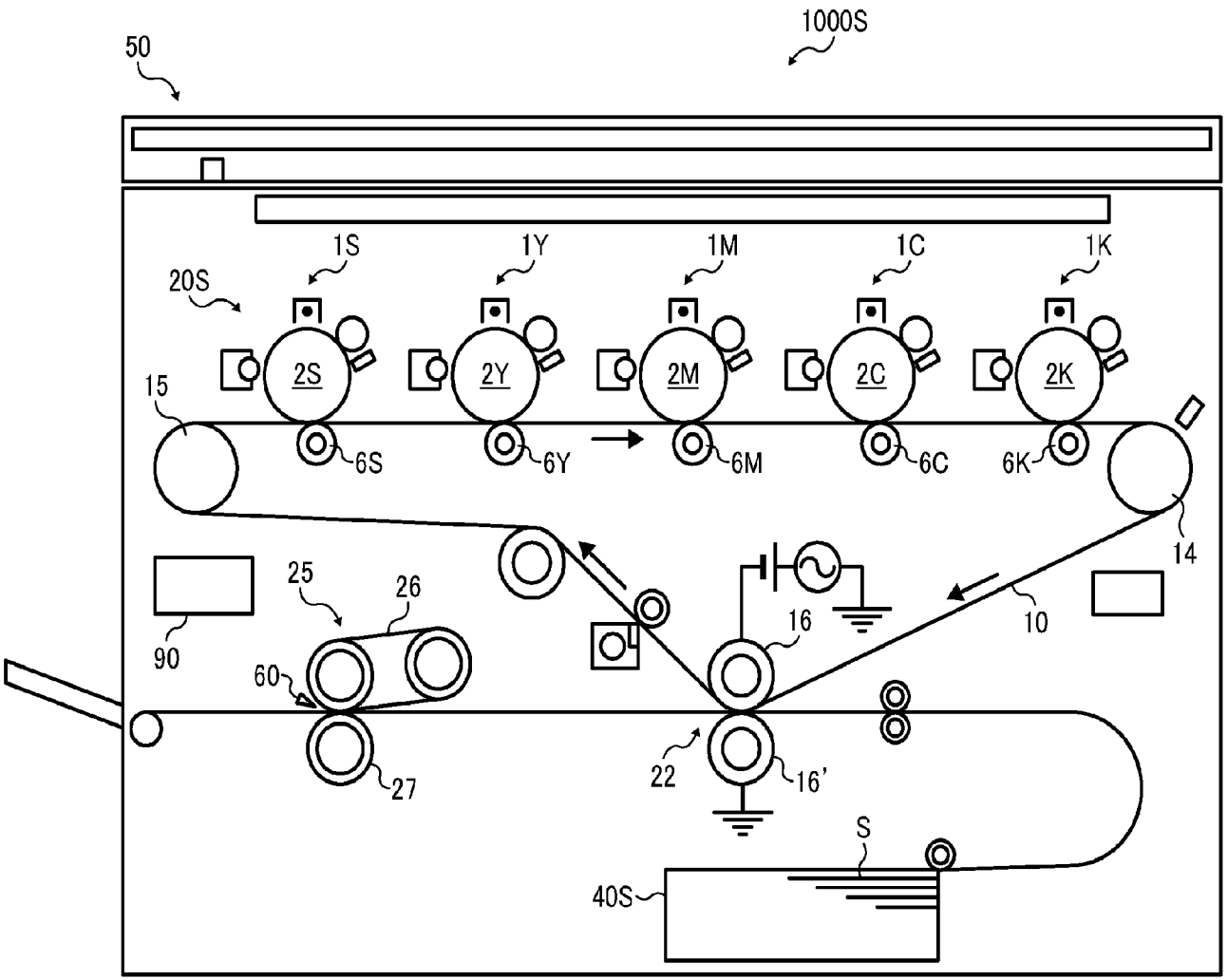
FIG. 20 is a schematic vertical sectional view of an image forming apparatus according to another exemplary embodiment of the present disclosure.

FIG. 20 is a schematic vertical sectional view of the image forming apparatus 1000S. To address a request from a print-on-demand market, the image forming apparatus 1000S is configured to form a value-added toner image. The image forming apparatus 1000S is a color image forming apparatus capable of value-added printing using a special-use toner in addition to primary color toners such as yellow, magenta, cyan, and black toners. The image forming apparatus 1000S includes at least one image forming unit using the special-use toner in addition to four image forming units using the four primary color toners, respectively.

For example, the special-use toner is a clear toner to apply gloss to the toner image T entirely or partially, a white toner used for overprinting or printing on a card for autographs, a metallic color toner, a fluorescent color toner, or the like. The clear toner is a colorless and transparent toner. If the clear toner adheres to a visible toner of the toner image T on the sheet S or to the sheet S, a user sees the visible toner or the sheet S through resin particles of the clear toner. For example, the clear toner is prepared by adding silicon dioxide ($SiO_2$) and titanium oxide ($TiO_2$) as an external additive to polyester resin having a low molecular weight. Alternatively, the clear toner may contain a coloring material in an amount that allows the user to see the sheet S or the visible toner adhered to the sheet S. The white toner contains a main ingredient similar to that of the clear toner. However, the white toner contains an increased amount of $TiO_2$ compared to the clear toner.

When forming the toner image T with the special-use toner and the four primary color toners, the toner image T formed on the sheet S contains an increased amount of toner adhered to the sheet S compared to when forming the toner image T with the four primary color toners. Accordingly, the increased amount of toner adhered to the sheet S as a strict image forming condition renders it difficult to fix the toner image T on the sheet S and separate the toner image T on the sheet S from the fixing belt 26. For example, when the toner image T formed on the sheet S with the clear toner to enhance gloss of the toner image T comes into contact with the front end 36*f* of the separation plate 36, the toner image T is more susceptible to damage than the toner image T formed without the clear toner.

A description is provided of another exemplary embodiment using the special-use toner.

As shown in FIG. 20, the image forming apparatus 1000S is a tandem copier employing an intermediate transfer method and including an image forming unit for the special-use toner. The image forming apparatus 1000S includes an image reader 50, an image forming device 20S, and a sheet feeder 40S. It is to be noted that identical reference numerals are assigned to components equivalent to those of the image forming apparatus 1000 depicted in FIG. 1 and a description of those components is simplified or omitted.

The image reader 50 reads an image on an original to create image data. The image reader 50 includes an exposure glass and a reading sensor such as a charge-coupled device (CCD) and a contact image sensor (CIS). The image forming device 20S includes an image forming unit 1S that forms a special-color toner image in addition to the image forming units 1Y, 1M, 1C, and 1K that form yellow, magenta, cyan, and black toner images, respectively. The image forming unit 1S includes a photoconductive drum 2S that bears the special-color toner image. A primary transfer roller 6S primarily transfers the special-color toner image from the photoconductive drum 2S onto the intermediate transfer belt 10. The five image forming units 1S, 1Y, 1M, 1C, and 1K use toners in different colors, that is, the special-color, yellow, magenta, cyan, and black toners to form special-color, yellow, magenta, cyan, and black toner images, respectively. However, the five image forming units 1S, 1Y, 1M, 1C, and 1K have a similar configuration except for the difference in color of toner. Each of the five image forming units 1S, 1Y, 1M, 1C, and 1K is detachably attached to the image forming apparatus 1000S, thus serving as a process cartridge. The image forming apparatus 1000S includes the fixing device 25 or 25S incorporating the separation device 60 that includes the separation plate 36 serving as a basic metal plate and the tape 38 serving as a surface layer coating the basic metal plate as shown in FIGS. 8 and 16, thus improving conveyance of the sheet S.

A detailed description of the construction of the separation device 60 is omitted because it is described above.

The amount of toner adhered to the sheet S during a print job in a special color mode under a five station image forming system that uses the five image forming units 1S, 1Y, 1M, 1C, and 1K shown in FIG. 20 is different from the amount of toner adhered to the sheet S during a print job in a full color mode under a four station image forming system that uses the four image forming units 1Y, 1M, 1C, and 1K. To address this circumstance, a fixing linear velocity at which the sheet S is conveyed through the fixing device 25 and a fixing temperature at which the toner image T is fixed on the sheet S are adjusted. Accordingly, if a controller 90, that is, a central processing unit (CPU), incorporated in the image forming apparatus 1000S, determines to actuate the image forming unit 1S using the special-use toner, the controller 90 changes a fixing condition of the fixing device 25, that is, at least one of the fixing linear velocity and the fixing temperature, from a fixing condition for the print job in the full color mode to a fixing condition for the print job in the special color mode.

A description is provided of advantages of the separation device 60.

As shown in FIG. 6, the separation device 60 separates a recording medium (e.g., a sheet S) bearing a toner image (e.g., a toner image T) that is ejected from the fixing nip N formed between a first rotator (e.g., the fixing belt 26) disposed opposite the toner image on the recording medium and a second rotator (e.g., the pressure roller 27) pressed against the first rotator. As shown in FIGS. 8 and 16, the separation device 60 includes a separator (e.g., the separation plate 36) that separates the recording medium from the first rotator. As shown in FIGS. 8, 9A, 10, 15, and 16, the separation device 60 further includes the plurality of recesses 39 including the first recess 39 and the second recess 39 disposed on the front end 36*f* of the separator disposed opposite the fixing nip N and the recording medium at least in a conveyance span on the separator where the recording medium is conveyed. As shown in FIG. 10, the first recess 39 extends in the first extension line 39*e* that is oblique relative to a recording medium conveyance direction (e.g., the sheet conveyance direction DS). The second recess 39 extends in the second extension line 39*e* that is oblique relative to the recording medium conveyance direction. For example, the extension line 39*e* of the first recess 39 overlaps the extension line 39*e* of the second recess 39 adjacent to the first recess 39 in a direction perpendicular to the recording medium conveyance direction to define the overlap span V.

According to this exemplary embodiment, the plurality of recesses 39 is disposed on the front end 36*f* of the separator disposed opposite the fixing nip N and the recording medium at least in the conveyance span on the separator where the recording medium ejected from the fixing nip N is conveyed. Accordingly, the recesses 39 reduce the area of the separator where the separator contacts the recording medium to separate the recording medium from the first rotator, suppressing friction between the separator and the recording medium as the recording medium slides over the separator. Consequently, the recesses 39 prevent the recording medium from being jammed by the separator and prevent gloss streaks from appearing on the toner image on the recording medium. As shown in FIG. 10, each of the recesses 39 extends obliquely relative to the recording medium conveyance direction in the extension line 39*e*. For example, the extension line 39*e* of the first recess 39 and the extension line 39*e* of the second recess 39 adjacent to the first recess 39 overlap in the direction perpendicular to the recording medium conveyance direction to define the overlap span V. Accordingly, the recesses 39 do not mark projections and depressions on a part of the toner image on the recording medium.

Further, the recesses 39 prevent a solid toner image on the sheet S from adhering to the separator as the sheet S is ejected from the fixing nip N and separated from the first rotator and prevent formation of gloss streaks on the toner image on the sheet S.

According to the exemplary embodiments described above, the fixing belt 26 serves as a first rotator. Alternatively, a fixing roller, a fixing film, a fixing sleeve, or the like may be used as a first rotator. Further, the pressure roller 27 serves as a second rotator. Alternatively, a pressure belt or the like may be used as a second rotator.

The present disclosure has been described above with reference to specific exemplary embodiments. Note that the present disclosure is not limited to the details of the embodiments described above, but various modifications and enhancements are possible without departing from the spirit and scope of the disclosure. It is therefore to be understood that the present disclosure may be practiced otherwise than as specifically described herein. For example, elements and/or features of different illustrative exemplary embodiments may be combined with each other and/or substituted for each other within the scope of the present disclosure.

What is claimed is:

1. A separation device for separating a recording medium ejected from a fixing nip formed between a first rotator and a second rotator from the first rotator, the separation device comprising:

a separator including a front end disposed opposite the fixing nip and the recording medium; and a plurality of recesses disposed on the front end of the separator at least in a conveyance span on the separator where the recording medium is conveyed, the plurality of recesses including:

a first recess extending in a first extension line that is oblique and straight relative to a recording medium conveyance direction; and a second recess adjacent to the first recess and extending in a second extension line that is oblique and straight relative to the recording medium conveyance direction, the second extension line overlapping the first extension line in a direction perpendicular to the recording medium conveyance direction to define an overlap span.

2. The separation device according to claim 1, further comprising a surface layer made of a material that facilitates sliding of the recording medium over the separation device, the surface layer provided with the plurality of recesses, wherein the front end of the separator includes a sheet disposed opposite the fixing nip and including a recording medium side face disposed opposite the recording medium and coated with the surface layer.

3. The separation device according to claim 2, wherein the surface layer includes a fluoroplastic tape.

4. The separation device according to claim 2, wherein the sheet of the front end of the separator has a thickness of 0.4 mm.

5. The separation device according to claim 2, wherein the plurality of recesses is disposed on the surface layer in a predetermined span thereon spanning from a position distanced from a front edge of the separator in the recording medium conveyance direction by a predetermined length.

6. The separation device according to claim 5, wherein the predetermined span on the surface layer includes:

a first band distanced from the front edge of the separator by the predetermined length in the recording medium conveyance direction; and a second band disposed downstream from the first band in the recording medium conveyance direction with a gap therebetween.

7. The separation device according to claim 1, wherein the separator includes a single plate extending in a longitudinal direction of the separator.

8. The separation device according to claim 1, wherein each of the plurality of recesses has a depth not smaller than 5 micrometers.

9. The separation device according to claim 1, wherein a pitch between the first recess and the second recess is not greater than 1 mm.

10. The separation device according to claim 1, wherein the plurality of recesses is treated with deburring press.

11. The separation device according to claim 1, wherein the plurality of recesses further includes:

a front recess disposed in proximity to the fixing nip and having a first depth; and a rear recess extending from the front recess and disposed downstream from the front recess in the recording medium conveyance direction, the rear recess having a second depth different from the first depth of the front recess.

12. The separation device according to claim 11, wherein the front recess is distanced from a front edge of the separator disposed opposite the fixing nip by 0.5 mm in the recording medium conveyance direction and has the first depth not smaller than 20 micrometers, and wherein the rear recess has the second depth not smaller than 3 micrometers.

13. The separation device according to claim 1, wherein the first recess is adjacent to the second recess with a pitch not greater than 1.2 mm.

14. A fixing device comprising:

a first rotator;

a second rotator pressed against the first rotator to form a fixing nip therebetween, through which a recording medium bearing an unfixed toner image is conveyed; and a separation device disposed downstream from the fixing nip in a recording medium conveyance direction, the separation device to separate the recording medium ejected from the fixing nip from the first rotator, the separation device including:

a separator including a front end disposed opposite the fixing nip and the recording medium; and a plurality of recesses disposed on the front end of the separator at least in a conveyance span on the separator where the recording medium is conveyed, the plurality of recesses including:

a first recess extending in a first extension line that is oblique relative to the recording medium conveyance direction; and a second recess adjacent to the first recess and extending in a second extension line that is oblique relative to the recording medium conveyance direction, wherein each of the first recess and the second recess includes a proximal end near the front end and a distal end farther down in the recording medium conveyance direction.

15. The fixing device according to claim 14, wherein the first rotator is disposed opposite the unfixed toner image on the recording medium, and wherein a front edge of the separator is disposed opposite the first rotator with a gap increasing from a center to a lateral end of the separator in a longitudinal direction thereof.

16. An image forming apparatus comprising:

an image forming device to form a toner image; and a fixing device disposed downstream from the image forming device in a recording medium conveyance direction to fix the toner image on a recording medium, the fixing device including:

a first rotator;

a second rotator pressed against the first rotator to form a fixing nip therebetween, through which the recording medium bearing the toner image is conveyed; and a separation device disposed downstream from the fixing nip in the recording medium conveyance direction, the separation device to separate the recording medium ejected from the fixing nip from the first rotator, the separation device including:

a separator including a front end disposed opposite the fixing nip and the recording medium; and a plurality of recesses disposed on the front end of the separator at least in a conveyance span on the separator where the recording medium is conveyed, the plurality of recesses including:

a first recess extending in a first extension line that is oblique and straight relative to the recording medium conveyance direction; and a second recess adjacent to the first recess and extending in a second extension line that is oblique and straight relative to the recording medium conveyance direction, the second extension line overlapping the first extension line in a direction perpendicular to the recording medium conveyance direction to define an overlap span.

17. The image forming apparatus according to claim 16, wherein the image forming device includes an image forming unit to form the toner image with a special-use toner.

18. The image forming apparatus according to claim 17, wherein the special-use toner includes a clear toner.

19. The image forming apparatus according to claim 17, further comprising a controller operatively connected to the fixing device to select a fixing condition for a full color mode when the controller determines to actuate the image forming unit.

20. The image forming apparatus according to claim 19, wherein the fixing condition includes at least one of a fixing linear velocity at which the recording medium is conveyed through the fixing device and a fixing temperature at which the toner image is fixed on the recording medium.

* * * * *